US008256488B2

(12) United States Patent
Ruggles et al.

(10) Patent No.: US 8,256,488 B2
(45) Date of Patent: Sep. 4, 2012

(54) COLLAPSIBLE LIGHT-WEIGHT PERFORATED PARTITION

(75) Inventors: Kay Ruggles, Salt Lake City, UT (US); Kirby V. Rea, Salt Lake City, UT (US)

(73) Assignee: 3form, Inc., Salt Lake City, UT (US)

( * ) Notice: Subject to any disclaimer, the term of this patent is extended or adjusted under 35 U.S.C. 154(b) by 0 days.

(21) Appl. No.: 12/619,203

(22) Filed: Nov. 16, 2009

(65) Prior Publication Data

US 2011/0114270 A1 May 19, 2011

Related U.S. Application Data

(63) Continuation of application No. PCT/US2008/063934, filed on May 16, 2008.

(60) Provisional application No. 60/938,694, filed on May 17, 2007.

(51) Int. Cl.
*E06B 9/06* (2006.01)

(52) U.S. Cl. ..... 160/84.04; 160/84.05; 160/84.01; 160/116; 160/113; 428/12; 428/9

(58) Field of Classification Search ..... 160/116, 160/180, 113, 84.01, 84.04, 84.05; 296/97.7; 428/12, 9; 40/610
See application file for complete search history.

(56) References Cited

U.S. PATENT DOCUMENTS 732,513 A * 6/1903 Braun ..... 428/9
1,827,718 A * 10/1931 Whitney ..... 160/84.02
2,201,356 A * 5/1940 Terrell ..... 160/84.02
2,281,022 A * 4/1942 Cavanaugh ..... 160/85
2,324,398 A * 7/1943 Kahr ..... 160/113
2,350,094 A * 5/1944 Butts ..... 160/84.04
3,593,671 A * 7/1971 Bramlett ..... 410/154
3,669,820 A * 6/1972 Fredericks ..... 28/116
3,701,376 A * 10/1972 Froget ..... 160/121.1
4,001,964 A * 1/1977 Hooker ..... 446/488

(Continued)

FOREIGN PATENT DOCUMENTS

WO 2008/144537 11/2008

OTHER PUBLICATIONS

PCT International Search Report for serial No. PCT/US2008/063934 dated Sep. 22, 2008 (2 pages).

*Primary Examiner* — Katherine W Mitchell
*Assistant Examiner* — Marcus Menezes
(74) *Attorney, Agent, or Firm* — Workman Nydegger

(57) ABSTRACT

A semi-private partition or covering includes a collapsible structure having a plurality of uniform perforations formed therein. The plurality of uniform perforations can be configured in size, shape, and dimension to provide not only aesthetic but functional differences from one partition to the next. A manufacturer can make a partition by forming a collapsible structure, such as by bonding a plurality of elongate cells along a plurality of different horizontal seams. The manufacturer can then position a plurality of cutout apparatus about the structure and apply the cutout apparatus to create hollow perforations passing through the entire depth of the collapsible structure (e.g., when expanded). The partition can be mounted to a top or side support structure for any combination of vertical or horizontal expansion/contraction of the partition.

11 Claims, 8 Drawing Sheets

U.S. PATENT DOCUMENTS 4,300,864 A * 11/1981 Liebel et al. ..... 410/154
4,374,877 A * 2/1983 Cole ..... 428/9
4,388,354 A * 6/1983 Suominen ..... 428/12
4,397,347 A * 8/1983 Brabant ..... 160/231.2
4,603,072 A * 7/1986 Colson ..... 428/116
4,732,630 A * 3/1988 Schnebly ..... 156/64
4,865,889 A * 9/1989 Boyse ..... 428/12
4,984,617 A * 1/1991 Corey ..... 160/84.02
5,184,659 A * 2/1993 Alcocer ..... 160/84.04
5,455,098 A * 10/1995 Cheng ..... 428/121
5,701,939 A * 12/1997 Pinto et al. ..... 160/84.01
D415,644 S * 10/1999 Goodwin ..... D6/576
6,047,759 A * 4/2000 Lysyj ..... 160/84.04
6,095,222 A * 8/2000 Voss ..... 160/84.05
6,103,336 A * 8/2000 Swiszcz ..... 428/116
6,192,642 B1 * 2/2001 Colson et al. ..... 52/506.06
6,199,337 B1 * 3/2001 Colson et al. ..... 52/506.06
6,319,586 B1 11/2001 Colson
6,427,409 B2 * 8/2002 Colson et al. ..... 52/506.08
6,572,725 B2 * 6/2003 Goodhue ..... 156/256
6,630,222 B1 * 10/2003 Fay et al. ..... 428/118
6,651,720 B1 * 11/2003 DiSilvestro et al. ..... 160/121.1
6,773,590 B2 * 8/2004 Prutkin ..... 210/321.75
7,109,885 B1 * 9/2006 Denlinger ..... 340/908
7,185,691 B2 3/2007 Toti
7,686,060 B2 * 3/2010 Anthony ..... 160/121.1
2007/0029052 A1 * 2/2007 Nien et al. ..... 160/84.05
2007/0039697 A1 * 2/2007 Sun et al. ..... 160/84.05
2009/0297736 A1 * 12/2009 Keighley ..... 428/12
2010/0062191 A1 * 3/2010 Koukal ..... 428/12

* cited by examiner

COLLAPSIBLE LIGHT-WEIGHT PERFORATED PARTITION

CROSS-REFERENCE TO RELATED APPLICATIONS

The present invention is a continuation of PCT Application No. PCT/US08/63934, filed May 16, 2008 entitled "Collapsible Light-weight Perforated Partition," which claims priority to U.S. Provisional Application No. 60/938,694, filed May 17, 2007, entitled "Collapsible Light-Weight Perforated Partition." The entire content of each of the aforementioned patent applications is incorporated by reference herein.

BACKGROUND OF THE INVENTION

1. The Field of the Invention

Implementations of the present invention relate generally to systems, methods, and apparatus for partitioning an interior space.

2. Background and Relevant Art

Conventional room partitions range from permanent to temporary, and include any number of materials for facilitating the same. For example, permanent room partitions, such as a wall, often include some form of dry wall mounted to one or more studs, with an applied finish or treatment. Temporary partitions, on the other hand, range from movable or modular walls and panels, and, in some cases, flexible types of dividers that are temporarily or semi-permanently affixed to a wall, ceiling, or floor structure. In addition, some flexible dividers include curtains, as well as hanging, ornamental items such as beads, or the like. Additional types of flexible dividers include sliding or accordion-style partitions that can moved and fixed into one position, and subsequently returned and fixed in an original position.

Most of these types of materials, whether permanent or temporary, tend to present unique sets of challenges that make them difficult to use in every environment where a partition is desired. For example, many of the above-mentioned materials tend for use in permanent partitions to be heavy, and/or can require fairly elaborate installation procedures. By contrast, some of the more temporary partition materials, such as curtains, hanging beads, or the like, tend to use very flimsy materials that provide little in the way of a partitioning structure, and further tend to provide either too much privacy or too little privacy as a partition. Specifically, most of the aforementioned materials tend to be insufficient for use as a semi-private partition, which operates as a partition, but is only partly see-through, or partly insulating.

Some examples of materials that can be sometimes used for private or semi-private ends include window blinds, such as collapsible window blinds. In general, collapsible window blinds can be made of any type of material resin materials such as MYLAR, or other types of plastics. In addition, the material for these types of collapsible window blinds tends to be chosen primarily for light blocking and insulating effects. The material for these types of collapsible window blinds tends to be chosen primarily for light blocking and insulating effects. For example, collapsible window blinds often include a honeycomb-like structure (as viewed from the side, cross-section), such as flexible diamond shapes that are joined at the bottoms and tops by another diamond in a continuing chain. The materials and shape used in this type of collapsible window blind tends to provide a double insulating layer for trapping air as well as light.

Unfortunately, the design, standard sizes, and overall shapes of such collapsible window blinds tend to make it impractical or impossible to use these types of materials as semi-private, or even decorative partitions for an interior or exterior room or other form of open space. In particular, decorations on such materials are usually limited to simple coloration or printing on the blind materials.

BRIEF SUMMARY OF THE INVENTION

Implementations of the present invention solve one or more problems in the art with systems and apparatus that provide a semi-private partition, which has a wide range of decorative and functional capabilities. In at least one implementation, for example, a collapsible structure (e.g., honeycomb-style, or the like) can be manufactured with a sufficient width and length for use as a room divider or partition. In addition, a manufacturer can use one or more cutout apparatus to form one or more different patterns in the collapsible structure. When expanded, the cut-out shapes (formed via the cutout apparatus) provide an aesthetically pleasing design that can be used not only as a semi-private partition or divider, but also one that is easy to use, flexible, semi-structural, and light weight.

For example, a collapsible, semi-private partition or covering configured to partition one or more spaces while diffusing light and sound therein can include a collapsible structure having a plurality of horizontal pleats that each splits a plurality of horizontal rows into opposing upper and lower portions thereof. The collapsible material expands in width when collapsed along the plurality of horizontal pleats. The collapsible partition also includes a plurality of fixed perforations formed in each of the horizontal pleats. Each perforation comprises a shape having a first half that spans into the upper portion of the horizontal row, and a second half that spans into the lower portion of the horizontal row. In addition, the collapsible partition includes at least one mounting plate mounted to one of the plurality of horizontal rows, the at least one mounting plate being configured to secure the collapsible partition to a support structure.

Furthermore, a method of manufacturing a collapsible, semi-private partition that partitions one or more spaces while diffusing light and sound therein can involve bonding a plurality of elongate cells along a corresponding plurality of horizontal seams. The bonded elongate cells form a collapsible structure that expands to at least about 8 feet. The method can also involve collapsing the collapsible structure along the plurality of horizontal seams and pleats so that each elongate cell from top to bottom in the collapsible structure overlaps with a vertically adjacent elongate cell. In addition, the method can involve removing material from opposing sides of each elongate cell in the collapsed, collapsible partition by applying one or more cutout apparatus on an uppermost elongate cell. Application of each of the one or more cutout apparatus forms a uniform column in the collapsible partition that corresponds to a shape of the corresponding cutout apparatus.

In addition to the foregoing, a system for reversibly partitioning the one or more spaces with one or more collapsible partitions configured to diffuse light and sound therein can include opposing first and second support structures. The system can also include a collapsible partition that is anchored to the first support structure, and that is releasably anchored to the second support structure. The collapsible partition includes a plurality of perforations fixedly formed therein, a plurality of adjacent horizontal rows each having a horizontal pleat formed therein. Furthermore, each of the plurality of perforations spans opposing sides of one of the horizontal pleats.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention extends to systems and apparatus that provide a semi-private partition, which has a wide range of decorative and functional capabilities. In at least one implementation, for example, a collapsible structure (e.g., honeycomb-style, or the like) can be manufactured with a sufficient width and length for use as a room divider or partition. In addition, a manufacturer can use one or more cutout apparatus to form one or more different patterns in the collapsible structure. When expanded, the cut-out shapes (formed via the cutout apparatus) provide an aesthetically pleasing design that can be used not only as a semi-private partition or divider, but also one that is easy to use, flexible, semi-structural, and light weight.

Accordingly, and as will be appreciated more fully from the following specification and claims, a partition in accordance with an implementation of the present invention can be manufactured for a wide variety of aesthetic and functional concerns, and can be carried, moved, and installed in a wide variety of locations. In particular, the partitions described herein can be manufactured for use in any number of ceiling or wall applications, whether in indoor or outdoor environments, including any residential, commercial, or industrial environments. In addition, the partitions described herein can be configured primarily for aesthetic/decorative use, such as to apply a particular look, and/or texture to a wall, column, or lighting element/arrangement in an interior or exterior space, to project patterns, or even to act more functionally as a light diffuser (e.g., a three-dimensional textile used as a lamp shade).

Along these lines, the partitions described herein can also be manufactured for virtually any length or width as appropriate for a given room partition, from several inches tall or wide to several feet in height or width. In one implementation, for example, the partitions described herein can be manufactured or otherwise joined to heights and/or widths from about as high or wide as 15 feet, 30 feet, or even 50 feet. Furthermore, the partitions described herein can be made with any color, style, or thickness, and can be made with single or multiple layering, or the like for added aesthetic and functional concerns. Still further, the partitions herein can be formed with virtually any cutout shape or dimension to impart both a function and aesthetic to the partition.

Figure 1B:
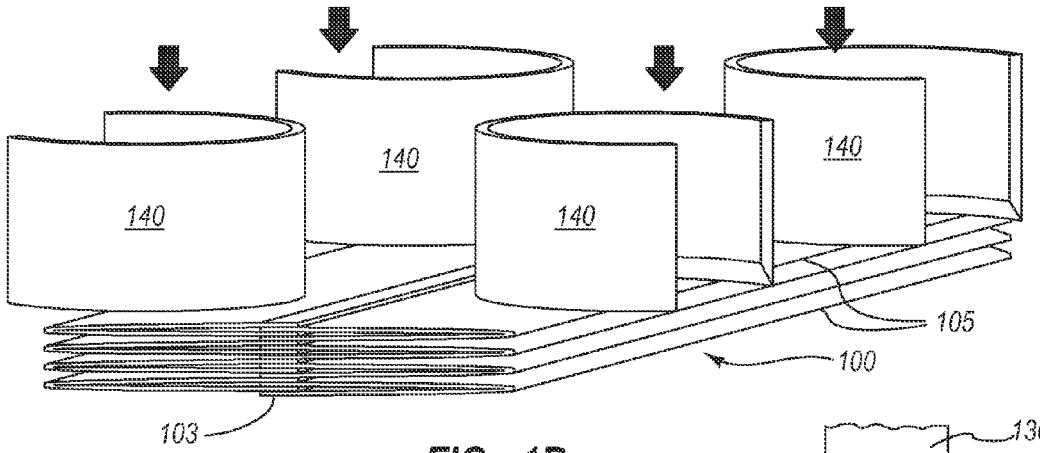
FIG. 1B illustrates a side perspective view of the single-cell partition shown in FIG. 1A when in a collapsed state, and prior to being cut.
Figure 1C:
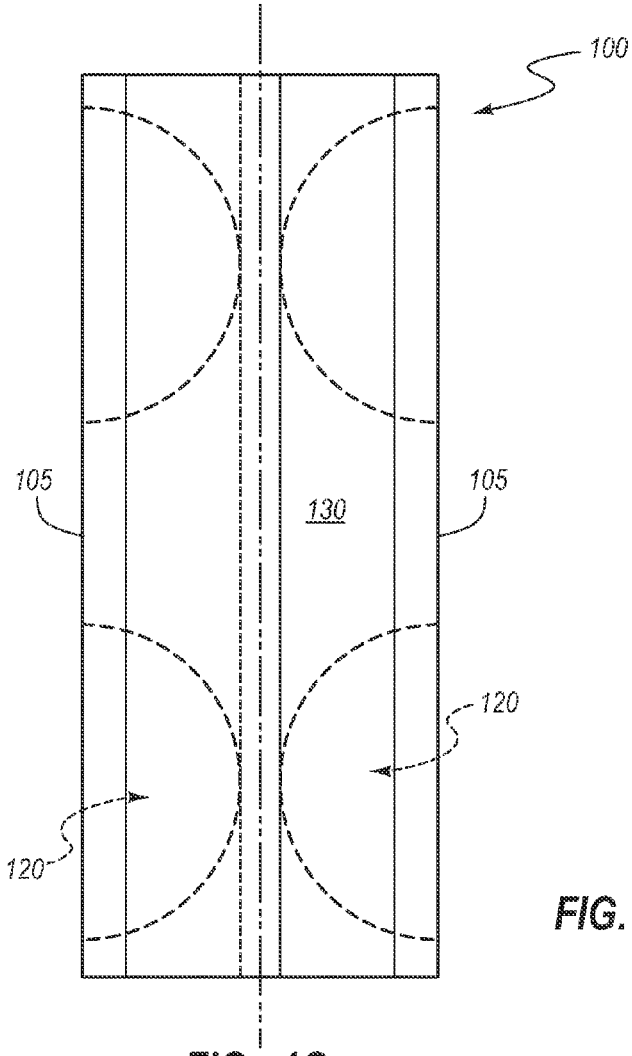
FIG. 1C illustrates a plan view of a collapsed partition showing potential cutout lines using the cutout apparatus shown in FIG. 1B.
Figure 1A:
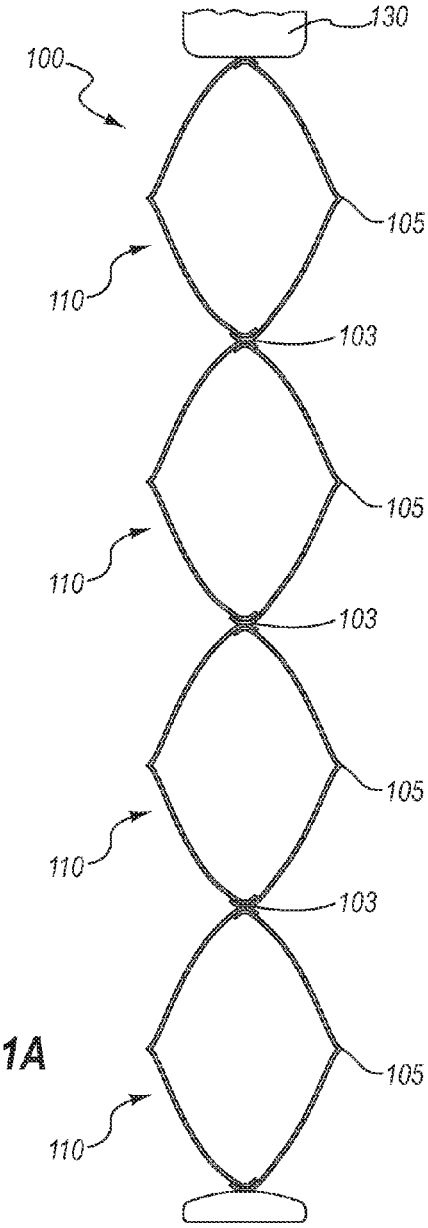
FIG. 1A illustrates a side view of a single-cell partition in accordance with an implementation of the present invention.

Referring now to the Figures, FIG. 1A illustrates a side view of a collapsible partition 100 in accordance with an implementation of the present invention. As shown, and as will be understood more fully herein, a collapsible partition 100 can comprise a plurality of elongate cells 110 (whether single or multiple-cell configurations) that are joined together at various seams 103. These elongate cells 110 generally comprise hollow cell materials, which can be tubular, diamond, square, or virtually any other shape at the cross-section. For example, FIG. 1A illustrates that the cells in the partition of FIG. 1A are approximately ovular or circular in the expanded state. In additional or alternative implementations, however, the collapsible structure 100 alternatively comprises a unitary material that is folded along a series of horizontal seams, thereby forming a zig-zag style structure (e.g., FIG. 2C) from the side or top view, as appropriate. Accordingly, one will appreciate that implementations of the present invention regarding cutting out portions of the collapsible partition apply equally to cell-type (or cell-in-cell) and unitary/zig-zag-type materials.

In either case, the material used in the collapsible partition 100 can comprise virtually any sufficiently flexible or collapsible material, such as paper (or paper-style materials), non-woven fabric, film materials, or even woven fabric. Other types of materials with which the partition can be made include resin materials such as MYLAR, flexible plastics, or other naturally occurring or synthetic materials such as polyester fiber and recycled polyester fiber, or the like, in addition, the fabric material can be chosen to have a quality of sheer, semi-sheer, opaque, or even semi-opaque (e.g., prior to creating perforations 120) appearance. The fabric material can also be chosen based on degree of translucence, and ability to transmit or block light between spaces in a partition. Furthermore, the chosen fabric or material can be combined with other materials in a particular configuration.

With particular respect to elongate cells, for example, the elongate cells can also be inserted within each other (i.e., cell-in-cell configuration), and even nested and/or bonded against each other to form any number of functional or aesthetic cross-sections, which include a set of single-cells, cells-within-cells. dual-cells, triple-cells, and so on. In general, the manufacturer can select the elongate cells (or tubes) based on any number of factors, including size and depth between seams 103 and pleats 105 along which the collapsible structure 130 will collapse, as well as the width and depth of the given cell. Furthermore, the manufacturer can select the number of elongate cells that are stacked vertically in order to result in a particular expanded size of a partition. In at least one implementation, for example, the manufacturer determines an appropriate number of elongate cells to create a partition that is at least 8 feet tall when expanded, and/or otherwise configured to span a ceiling-to-floor space.

As previously mentioned, however, the manufacturer can create a much longer or wider sheet or partition by adjoining additional elongate cells, or even adjoining partitions/sheets together. In one implementation, for example, the manufacturer cuts partitions or sheets (e.g., elongate cell or unitary material structure) to multiple 10 foot lengths. The manufacturer then prepares a glue line and seams two or more partitions or sheets together so as to appear as one piece. In at least one implementation, the manufacturer can make a partition, sheet, or other form of treatment that is anywhere from 15 feet long, to 30 feet long, or even as long as 50 feet long or longer. Such a partition can be used to simply partition a space, or even to treat an existing wall, floor, or ceiling structure. The sheet/partition (e.g., 100/100*a*/100*b*) can also be used to adorn another structure, rather than just a conventional ceiling, wall or floor.

In either case, when a user collapses the partition 100, each elongate cell 100 is generally configured to collapse at an approximate midpoint, thereby forming opposing pleats 105 on each cell 110. In general, each pleat can be thought to provide a mid point for an "upper portion" and a "lower portion" for each elongate cell. Thus, for example, one configuration of pleats 105 that are about ⅜" deep result from elongate cells 110 that are about ¾" wide when collapsed. In additional or alternative configurations, the pleats 105 are configured to be anywhere from about ⅜" deep to about 1" deep (i.e., spaced apart from each other) or greater. This choice in pleat 105 depth applies not only to elongate tubes, but also to unitary materials that are simply folded along a zig-zag pattern (e.g., FIG. 2B). Along these lines, FIG. 1B illustrates a side perspective view of the collapsible structure 100 when in a collapsed state.

Upon selecting the particular materials and pleat/seam spacing, the manufacturer can then bond (e.g., glue, affix, secure, heat seal, tape, or apply vibration-style sonic bonding, etc.) the elongate cells together in a particular cross-sectional alignment with one or more next or adjacent elongate cells. The affixed or bonded elongate cells thus form a structure with a plurality of uniform, horizontal seams 103 at the affixed/bonded points. In general, the hollow elongate cells/tubes of the collapsible partition 100 are of such material, and are specifically positioned together, so that the entire structure 100 can be easily expanded and collapsed onto itself along the horizontal seams 103 and pleats 105 from top to bottom along virtually the same vertical axes (e.g., columns 115, FIG. 2A), and for each horizontal length of elongate cell.

FIG. 1A (as well as 1C, 1D, etc.) also shows that partition 100 can comprise a plurality of mounting plates 130 positioned at extreme edges of partition 100. In general, mounting plates 130 can be made from virtually any material, although typically from more rigid materials such as relatively rigid, inflexible plastics, metals, or composites thereof. In one implementation, each plate 130 is configured in size and shape to mount (permanently, semi-permanently, or temporarily) the partition 100 to a ceiling (e.g., vertical/drop-down layouts), wall (e.g., in horizontal/side-to-side layouts), floor, or other form of support structure. In most cases, the opposing plate 130 will not be mounted to two opposing surfaces, as such, but rather will be used to either weigh down the collapsible structure (e.g., when stretched from a ceiling), or only temporarily mount or hold the partition at an opposing end. In other cases, such as with a horizontal layout, the partition is configured to be mounted or folded out to two vertically-standing support structures.

To create the various illustrated aesthetic and functional features of the semi-private structure (e.g., FIG. 2A), a manufacturer can use one or more cutout apparatus 140. In at least one implementation, the cutout apparatus 140 comprises any one or more of a die-cut apparatus, saw, hole saw, laser cut apparatus, or water jet apparatus sufficient for cutting through the chosen material of the collapsible structure 100. In particular, and as understood more fully herein, the manufacturer uses the cutout apparatus 140 to impart a series of particular shapes (e.g., perforations 120, FIG. 2A) in the collapsible structure, and ultimately in the partition 100. To this end, FIG. 1B illustrates an implementation in which the manufacturer chooses the cutout apparatus 140 as an open-sided blade tool (e.g., 140, FIG. 1B) that is pressed against the material with a pneumatic press. In additional or alternative implementations, the cutout apparatus 140 can comprise a closed tool such as a coring drill bit.

In any event, FIG. 1B illustrates an implementation in which the manufacturer collapses the collapsible structure 100 so that each of the elongate cells 110 overlaps or collapses against a next adjacent elongate cell, and then positions half-circle cutout apparatus 140 at or about the seams 105 thereof (e.g., in a collapsed state). Of course, one will appreciate that the manufacturer can adjust and select the cutout apparatus 140 (or select alternate forms of the apparatus) in terms of size, shape, depth, width, or other form of design for both aesthetic as well as functional ends. At least some of the considerations that can drive these optimizations include the amount of light and/or sound that a designer will want to allow transmitted between partitioned spaces. One will appreciate that such optimizations can relate not only to the size, depth, and arrangement of each perforation, but also the shape and dispersion of a plurality of different perforations.

With respect to perforation shape, for example, the manufacturer might configure the cutout apparatus 140 so that it imparts any one or more of circular, diamond, heart, flower, square, oval, star, hexagonal, octagonal shapes, or the like in partition 100. In addition, the manufacturer might alternate different shapes along a horizontal length of the collapsible partition. For example, the manufacturer might choose to create a column of star shapes, then a column of circle shapes, following with another column of star shapes and so on. In additional or alternative implementations, the manufacturer might randomly disperse cutout apparatus shapes 140, as well as their positioning relative to center line 133, along the collapsed, collapsible partition in order to achieve any number of desired ends.

Specifically, the manufacturer might choose a particular size of the cutout shape in order to allow a certain amount of light through the partition, or to insulate or release a select amount of air (hot or cold), sound, or the like through partition 100. Along these lines, and with further respect to perforation 120 size, the manufacturer may position the cutout apparatus relatively near the center 133 (on opposing sides of center 133) of the collapsed, collapsible structure 100 to create a relatively large perforation 120. By contrast, to create a smaller perforation 120, the manufacturer can position the cutout apparatus 140 relatively near the peripheral edge of pleat 105, and thus farther from the center line 133 of the collapsed, collapsible structure 100. In some cases, the manufacturer can even choose only to cutout one side of the collapsed structure. In such a case, the manufacturer may create a perforation that does not necessarily extend all the way through the given elongate cells, but nevertheless thins out the material for additional aesthetic or functional effects.

In either case, at least one implementation involves the manufacturer selecting the position of the cutout apparatus 140 relative to the collapsed, collapsible structure 100 to create hollow perforations 120 that are at least ¼" in any or all dimensions. In another implementation, the manufacturer selects and positions the cutout apparatus 140 to create hollow perforations 120 that are at least 1.25" in diameter within a 1.5 inch" wide collapsible structure 100. In additional or alternative implementations, a manufacturer gauges how much material is removed as a percentage of the structure weight.

In one implementation, for example, the manufacturer can remove from about 10-80% (with about 90-10% remaining) of a collapsible partition, preferably from about 25-60% of material (with about 75-40% remaining). In still other implementations, the manufacturer selects the material, cutout, cutout depth, and cutout shape as a function of the amount of light, sound, or air intended to ultimately pass through the expanded collapsible structure 100, and ultimately the level of privacy (or lack thereof). For example, the manufacturer can determine an amount of light or sound that should be transmitted between spaces to be partitioned, and then optimize the shape, arrangement, and size of each cutout apparatus in order to achieve a perforation that results in passage of the determined amount of light or sound.

In any event, upon selecting the size, shape, dimension, and positioning of the materials and cutout apparatus, the manufacturer prepares a "cutout assembly" (i.e., including the cutout apparatus positioned over the collapsible structure in collapsed form). The manufacturer then applies the cutout apparatus 140 on the collapsible partition. In at least one implementation, the manufacturer applies the cutout apparatus 140 through the collapsible structure 100 on both sides of the collapsed, collapsible structure through the entire vertical length, and along as much of the horizontal length of the collapsible structure as desired. For example, the manufacturer depresses a pneumatic press comprising one or more particularly aligned cutout apparatus 140, or depresses a coring drill bit-form of the cutout apparatus 140 onto the collapsed material, in either case within the particularly selected pattern.

FIG. 1C illustrates a plan view of the intended application/pattern of the cutouts shown in FIG. 1B. As shown, the intended pattern is typically a partial form of the intended resulting shape. For example, to impart a circle shape, the intended pattern (e.g., FIG. 1C) in the collapsed form of the material will be half-circle, as illustrated. For a star shape, the intended pattern in the collapsed form of the material will have the appearance of a half-star. One will appreciate, therefore, that the removed material will thus result in a perforation 120 that spans virtually equal, opposing spaces about a pleat 105 in a given elongate cell.

Figure 1D:
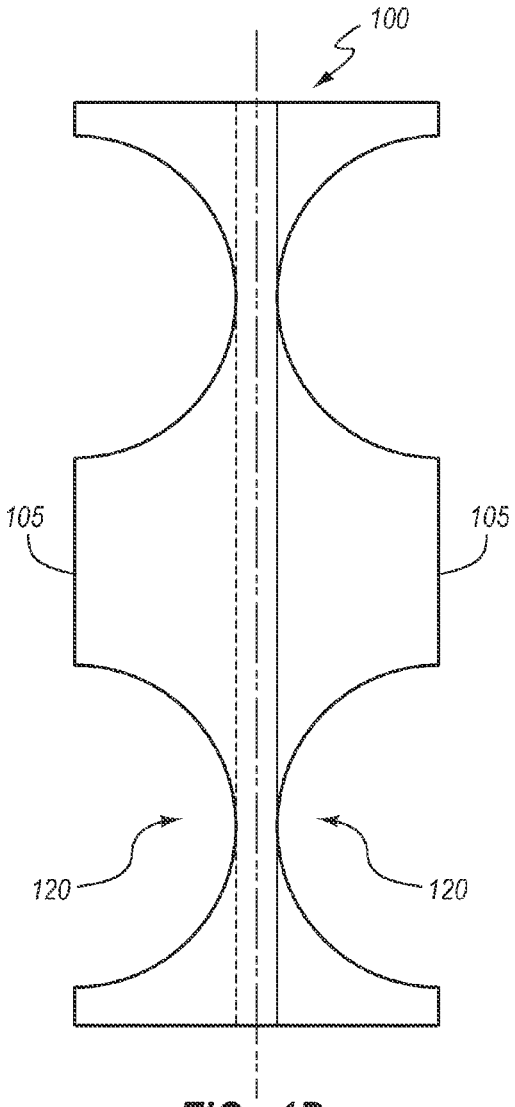
FIG. 1D illustrates a top view of one or more elongate cells in a partition after one or more cutout apparatus have been applied.
Figure 1E:
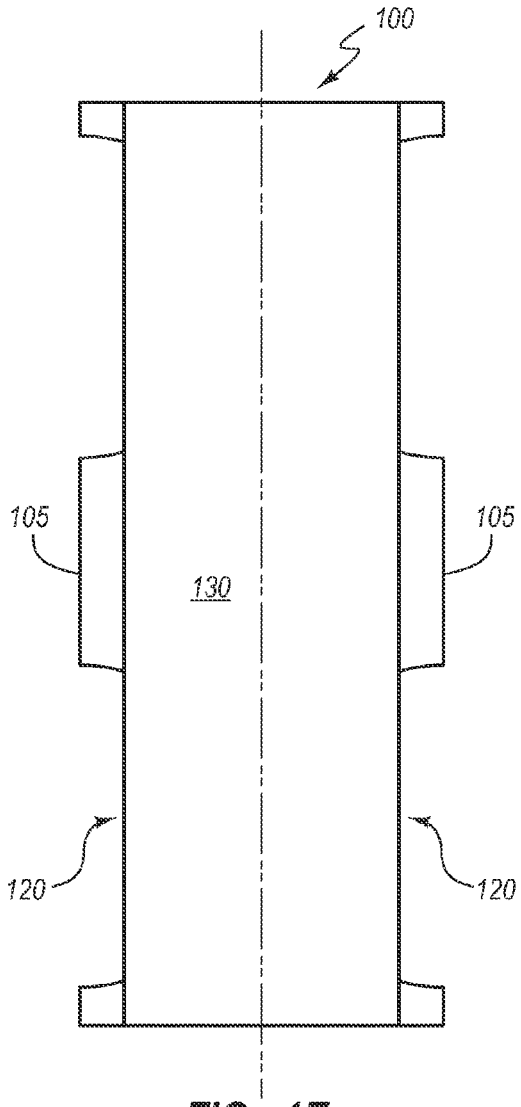
FIG. 1E illustrates the collapsed, cutout elongate cells of FIG. 1D when the manufacturer has affixed one or more mounting plates to a top and bottom portion thereof.
Figure 1F:
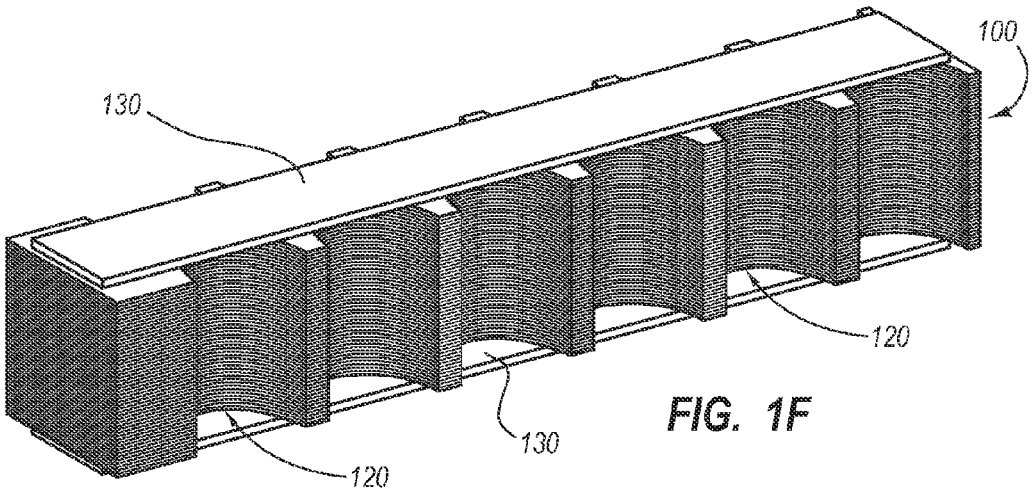
FIG. 1F illustrates a side perspective view of the partition shown in FIG. 1E when the elongate cells are in a collapsed state.
Figure 1G:
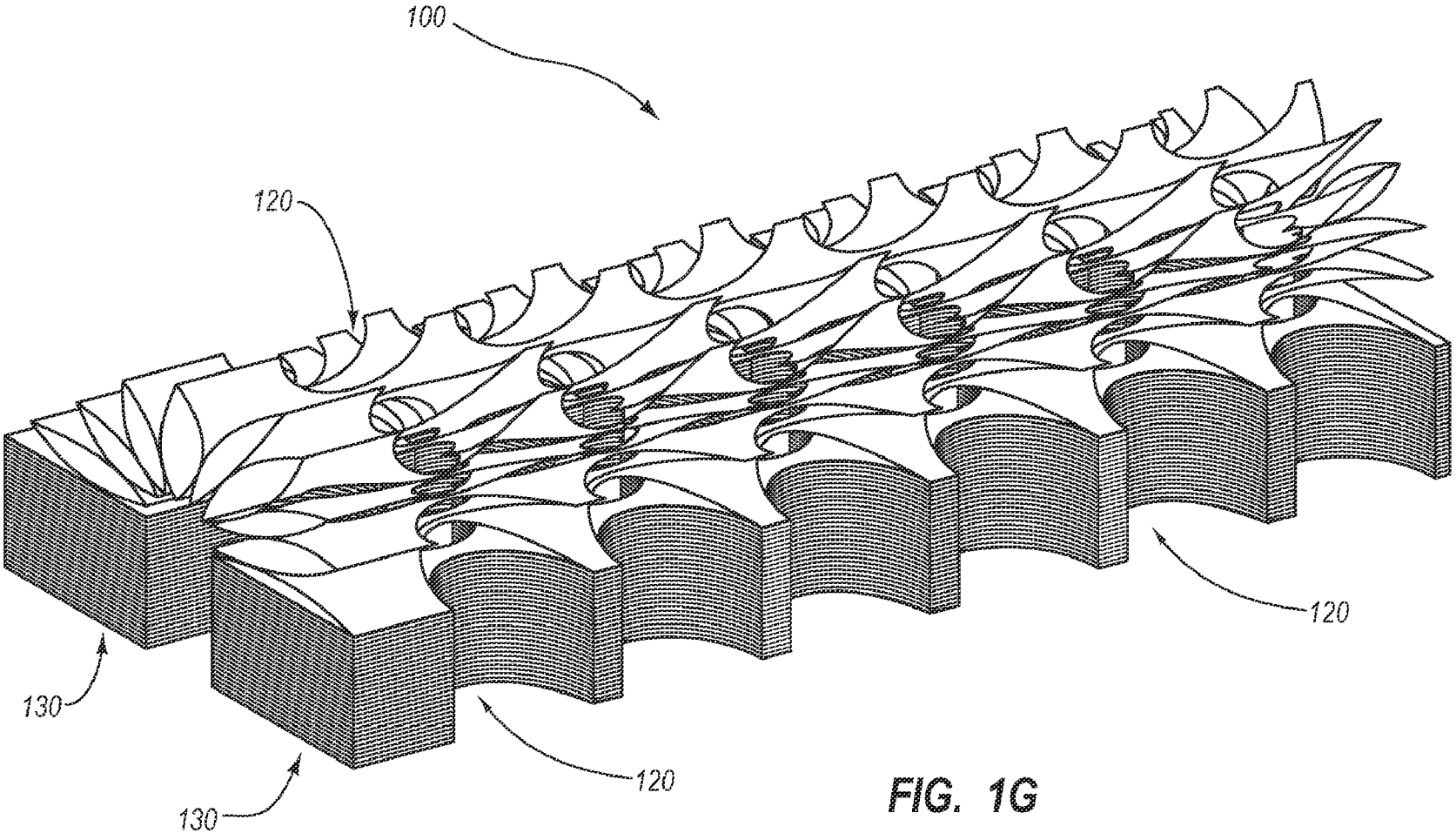
FIG. 1G illustrates a side perspective view of the partition shown in FIGS. 1E-1F when the partition is partially expanded or folded out.

In any event, FIG. 1D shows that the manufacturer has thus applied the cutout apparatus 140. and subsequently removed the cutout material. Similarly. FIG. 1E illustrates a plan view of the collapsed, collapsible structure 100 shown in FIG. 1D after the manufacturer has applied or affixed mounting plates 130. Furthermore. FIG. 1F illustrates a side perspective view of the collapsed, collapsible structure 100 shown in FIG. 1E. Still further. FIG. 1G illustrates the partition of FIG. 1F when partly expanded or folded out.

Accordingly, one will appreciate that applying the cutout apparatus 140 to a collapsed form of the collapsible structure 100 can result in a series of uniformly shaped and positioned perforations 120 in each elongate cell 110, which, when the collapsible structure is expanded, fornix a column 115 corresponding to the shape of the cutout apparatus 140. Such uniformity, however, is not required. In particular, a manufacturer can even stretch out the collapsible structure, and cutout any type or shape of uniform or non-uniform patterns as hollow perforations 120, so that a column 115, as such, is less apparent or otherwise not formed. In one implementation, for example, the manufacturer lays out a collapsible partition in expanded form, and uses one or more of a laser cutout apparatus or a water jet cutout apparatus to cut any number of different or alternative shapes in the expanded, collapsible structure 100.

Figure 2A:
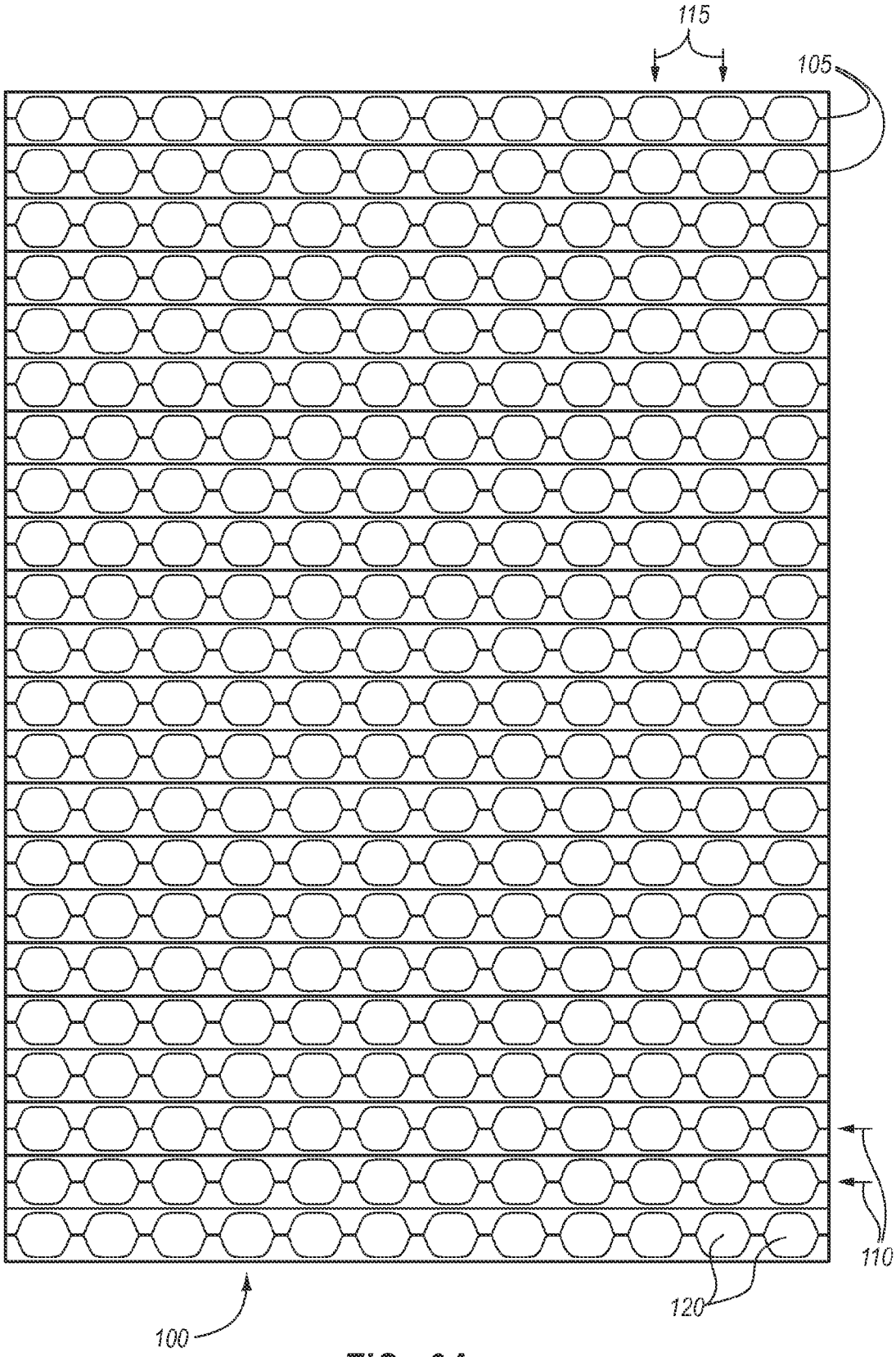
FIG. 2A illustrates a front, facing view of the partition shown in FIGS. 1E-1G when in a fully expanded state.

FIGS. 2A through 3B illustrate various features of a finished, exemplary collapsible partition 100 when in an expanded (or at least partially expanded) form. For example, FIG. 2A shows that partition 100 comprises a plurality of hollow perforations 120 (hollow all the way through from one side to the next) formed in a row/column alignment. In particular, FIG. 2A shows that at least one implementation of a collapsible partition 100 can comprise a series of columns 115 corresponding to the shape of the cutout apparatus 1401. That is, each cutout apparatus 140 cuts through and creates each entire column 115 in a set of adjoined elongate cells 110. In addition, FIG. 2A shows that each elongate cell 110 further defines a row in the collapsible partition 100.

Figure 2B:
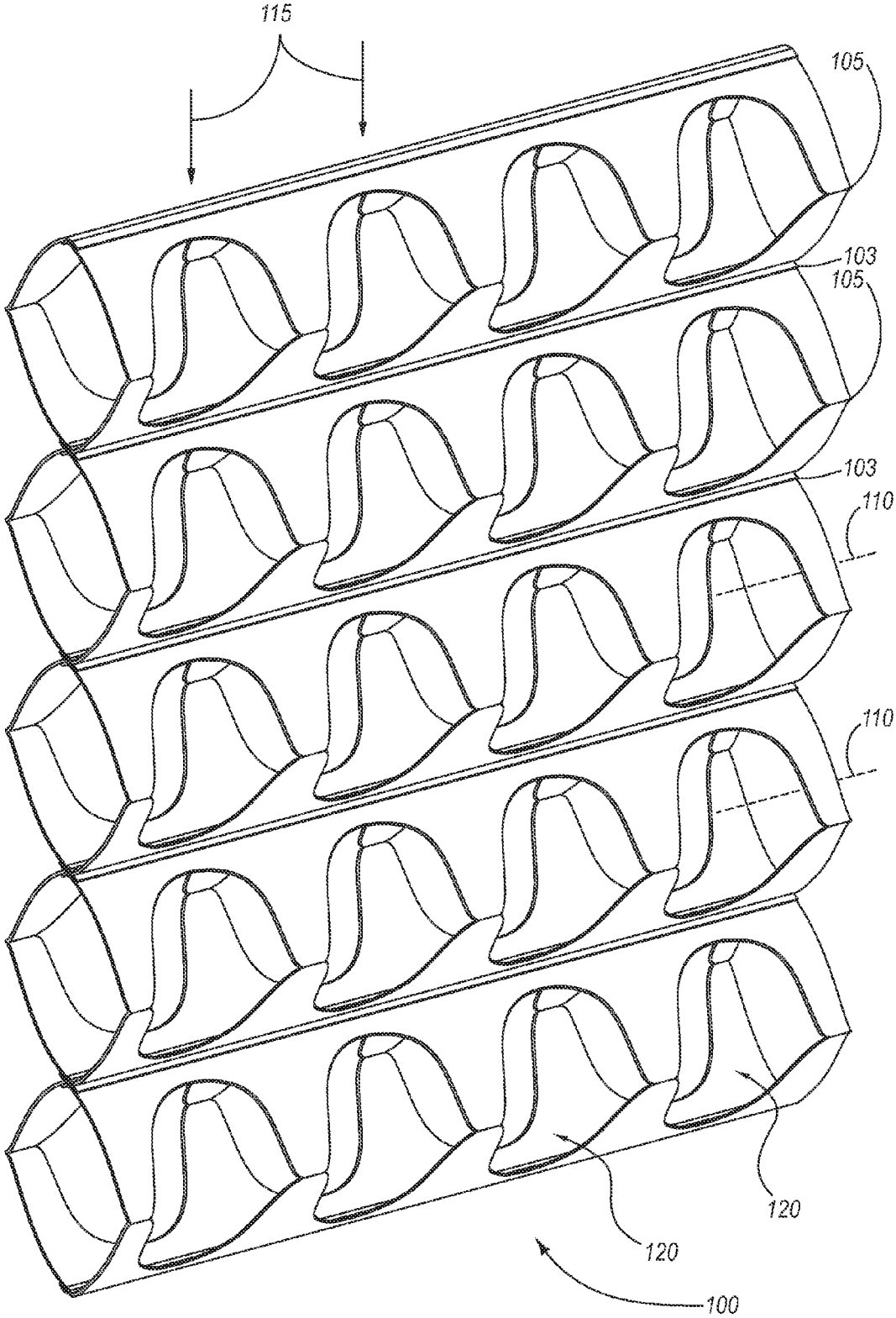
FIG. 2B illustrates another side perspective view of a plurality of elongate cells in a single-cell partition in accordance with an implementation of the present invention.

As previously mentioned, the removed material generally results in the ability to intermittently or differentially pass light or sound through the partition 100. For example, FIG. 2A shows that the perforations 120 allow at least some light to pass through partition 100 generally, with all light being able to pass through any given hollow perforation 120. Of course, peering directly through any given perforation 120 (when perforated completely through an elongate cell 100) provides a clear line of sight to at least a portion of the person standing on the other side. Thus, the resultant partition 100 is at least "semi-private." FIG. 2B shows a side perspective view of the collapsible partition 100 shown in FIG. 2A. In particular, FIG. 2B shows the cross-section of a single cell partition 100 in expanded form.

Figure 2C:
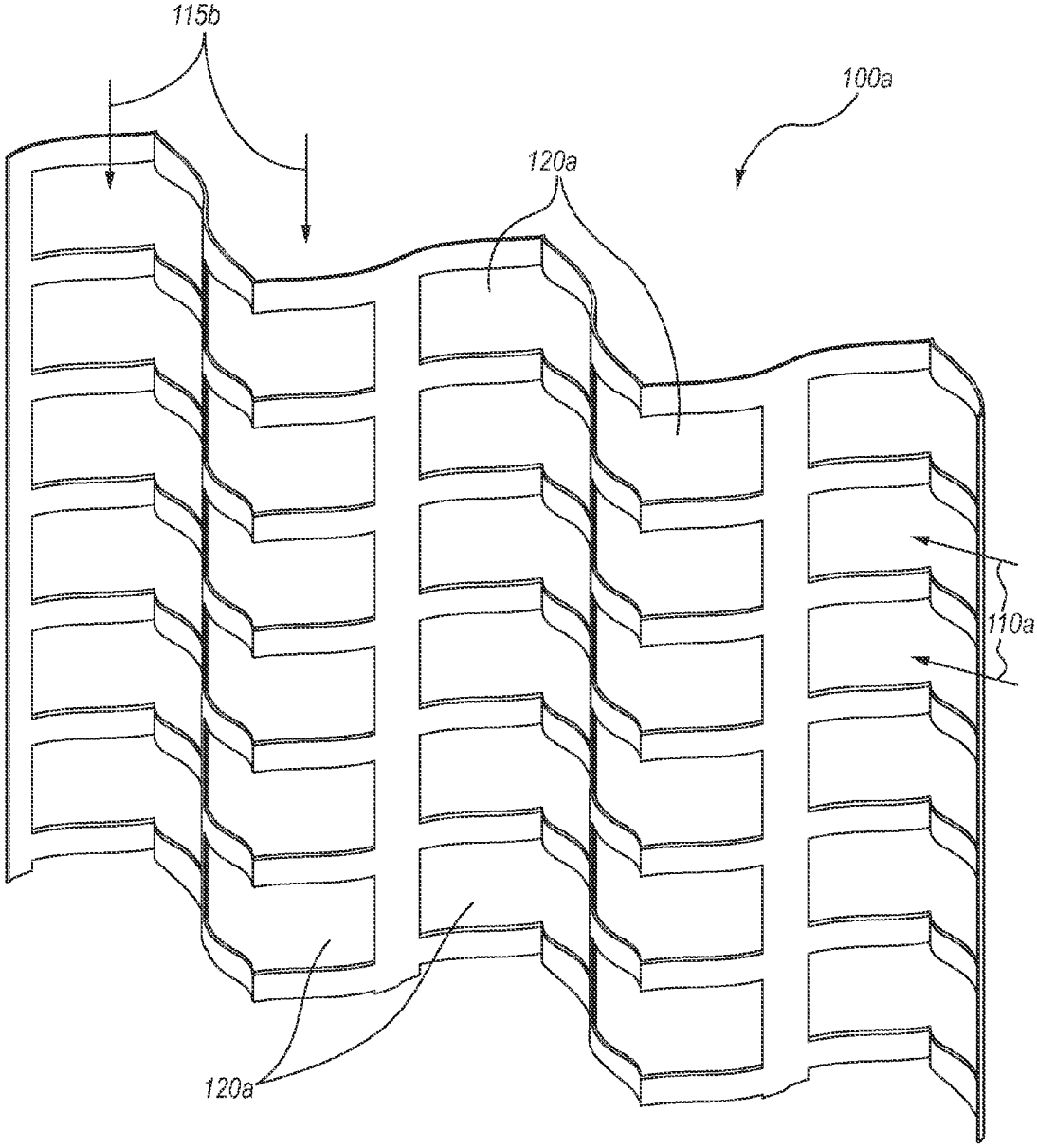
FIG. 2C illustrates a side perspective, cross-sectional view of an alternate design of a partition in which a manufacturer has cut one or more squared lines into a unitary material, in accordance with an implementation of the present invention.

As previously mentioned, however, circular perforations as primarily illustrated herein, are but one of the many different types of shapes that a manufacturer can choose to use in order to optimize the amount of light and/or sound that can pass through. FIG. 2C shows a facing view of another, differently shaped collapsible partition 100*a* in accordance with an implementation of the present invention. In particular. FIG. 2C illustrates a partition 100*a* that has been created using a different shape (hexagonal-shaped) of cutouts.

FIG. 2C also illustrates that the collapsible partition in this particular case can comprise a unitary material, rather than on a set of bonded cells, as with partition 100. In at least some cases, the manufacturer chooses a unitary material since it may allow more light or sound to pass through than the otherwise described cell structures. That is, cell structures generally mean that light or sound can be blocked by effectively two different walls in a given elongate cell. A unitary material, however, only provides a single wall barrier for light and sound (unless combined with another unitary material for a double wall construction). In any event, FIG. 2C also shows hollow perforations 120*a* that have been formed along square/rectangular-style patterns in the corresponding collapsible structure. In this example, the manufacturer has chosen not only the material (single layer, unitary material), the shape (wide hexagons), the style, and the general dimension of the cutout patterns to allow more light (or even air, sound, etc.) through the partition 100*a* compared with a cell-structure partition.

Figure 3A:
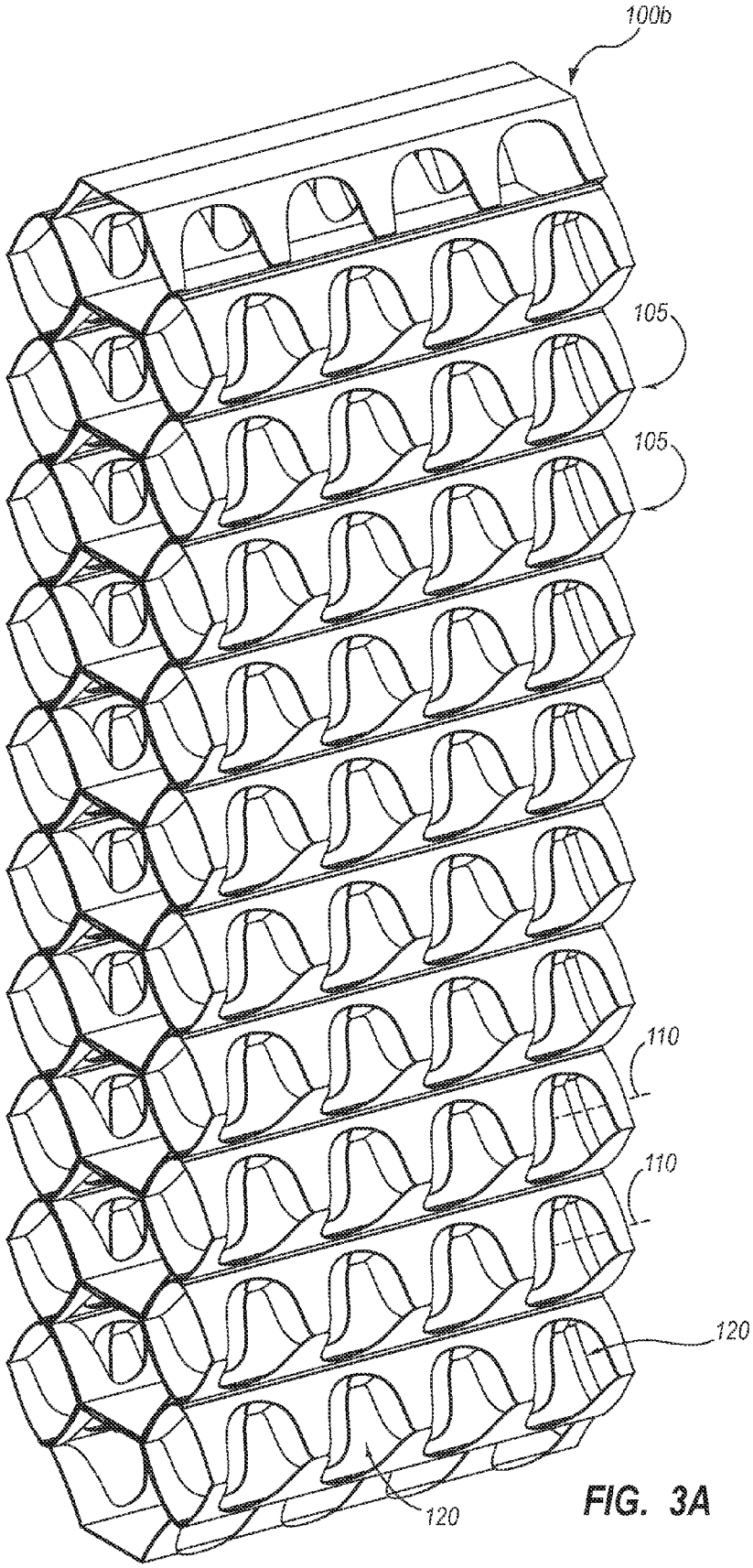
FIG. 3A illustrates a side perspective, cross-sectional view still another design of a partition using a triple cell configuration in accordance with an implementation of the present invention.
Figure 3B:
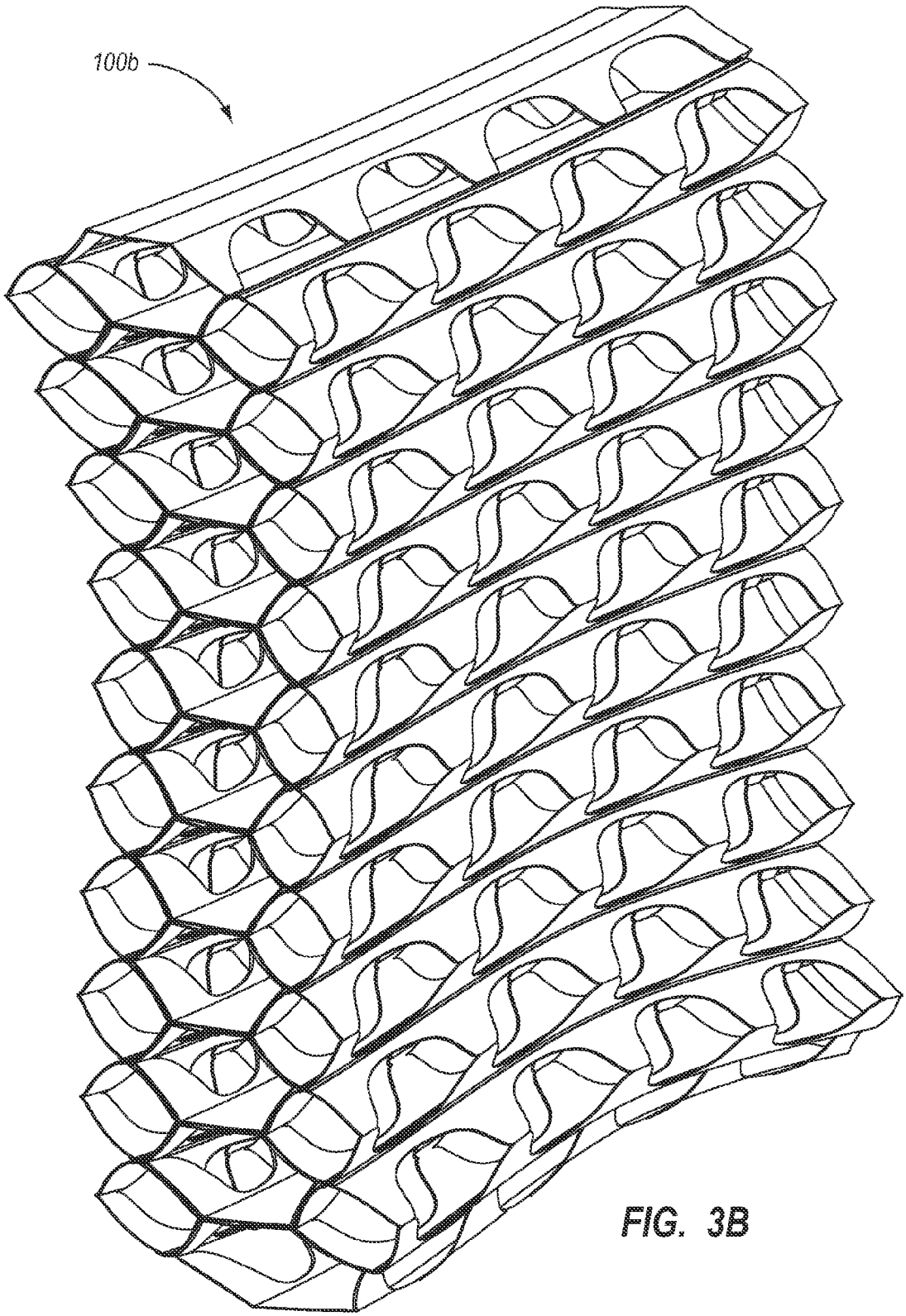
FIG. 3B illustrates some of the flexibility properties of a partition in accordance with an implementation of the present invention, such as the partition shown in FIG. 3A.

FIG. 3A illustrates a side-perspective view of yet another partition 100*b*. which includes a plurality of elongate cells/rows 110 that are bonded along alternating seams and pleats (similarly as described for partition 100). In this example, because the manufacturer has bonded the plurality of tubes for a "triple cell" design, the cells are bonded along seams that are somewhat staggered in formation (e.g., in honeycomb formation). FIG. 3B illustrates another side, cross-sectional view of the partition of FIG. 3A, albeit when twisted. In particular, FIG. 3B illustrates at least one advantage of one or more of the designs, such as the triple cell partition 100, which is that the partition can be not only light weight and collapsible, but also flexible. One will appreciate that the flexibility provided by these materials provides yet another consideration for a designer that is optimizing a partition of opposing spaces not only in terms of functional light/sound dispersion goals, but also various aesthetic ends.

Accordingly, FIGS. 1A-3B and the corresponding text illustrate or describe a light-weight, collapsible structure with three-dimensional features, or otherwise a three-dimensional textile structure. The textile structure can be easily manufactured, assembled, joined together, and stored/reused as desired in a particular location, such as for use as a wall, or ceiling structure/partition, or other form of space divider or adornment. The three-dimensional partition/structure can be used to generally provide a semi-private barrier or divider, which can allow light, air, or sound on a differential basis depending on the size, dimension, or otherwise shape of the cutout apparatus, as well as the color, translucency, and material used to create the initial collapsible structure. The three-dimensional partition/structure can also or alternatively be used to provide a space with an artistic component, which adds to various functional and aesthetic features in a given space. One will appreciate that implementations of the present invention can be used in any home or office environment where an at least temporary, aesthetically pleasing, three-dimensional textile structure is desired.

In addition, and as previously mentioned, implementations of the present invention can be configured for a wide range of lengths, widths, and even vertical or horizontal layout configurations. For example, the depth and size of collapsible materials and corresponding cutouts can be configured to create potentially as high as anywhere from 12-50 foot (or longer) partition/structure/treatment that is also perhaps 1 to several feet wide (e.g., a large wall-style partition or covering), or even much smaller dimensions for smaller partitions or coverings. As also previously mentioned, the partition 100 (or 100*a-b*) can also be configured to drop down from an upper or ceiling support structure, or to be pulled across a horizontal length from one side to another, and thus anchored at two vertical standing posts. The partition can be even further configured with sufficiently rigid materials in some cases to be complete free standing (or at least anchored with only one post).

In addition, the hollow perforations 120 (or 120*a*) can be chosen and configured to project certain designs or shapes onto a wall, and/or for light diffusion techniques. In one implementation, for example, the partition is configured in size, shape, and perforation to cover a wall or other form of panel or partition. In between the opposing partition and the perforated, collapsible partition 100 can be positioned near or about a plurality of light sources, such as halogen or fluorescent bulbs, light emitting diodes, or the like. When the lights are turned on (and effectively trapped between the wall and collapsible partition), the perforated, collapsible partition 100 can project or otherwise create a unique aesthetic and functional effect. In one implementation, the perforated, collapsible partition 100 is further configured to wrap around a light source or light tube, for similar light diffusion effects (e.g., as a lamp shade).

Furthermore, and as also previously mentioned, the collapsible, perforated partitions 100 described herein can be useful in any range of residential, commercial, and/or otherwise industrial purposes. For example, the partition 100 can be used to separate living spaces in a home or to separate outdoor spaces on a patio, garden, or deck, just as the partition 100 could also be used as a semi-private partition/barrier in virtually any interior or exterior work space. Accordingly, the principles of using and creating a semi-private collapsible partition in accordance with implementations of the present invention can be applied broadly both for structural partitions in existing spaces, and as treatments to existing structures.

One will appreciate, therefore, that any of the illustrated partitions (e.g., 100-100*b*) can be used easily in virtually any environment (indoor, outdoor) to provide any number of different aesthetic and functional effects and for any number of aesthetic and/or functional uses, including purely aesthetic or purely functional uses, as desired. In particular, the partitions described herein can be used not only to divide a space (interior or exterior), but also in some cases just as a retractable covering. As with the partitions described herein, the retractable covering is specifically cut to differentially filter or otherwise diffuse light coming through from another space, such as light coming through a translucent glass/resin panel or other form of space partition.

Although not shown, any or all of the partitions illustrated or otherwise described herein can be manufactured to contain one or more collapse and release apparatus, such as one or more draw string-style apparatus (e.g., with vertically collapsing structures) that are typically used with window blinds. In particular, any or all of the partitions can be constructed with a wide range of collapse and release apparatus, so that a user can pull on a string or cord to release or expand the partition to any full or partition expanse/collapse dimension. One will appreciate that there may be many reasons or implementations in which a user will want to only partly expand or collapse a given partition, and still obtain a particular function or aesthetic that is unique to that partition's particular state of expanse/collapse.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. In an architectural design environment comprising one or more spaces to be partitioned, a collapsible, semi-private partition or covering configured to partition the one or more spaces while diffusing light and sound therein, comprising:

a collapsible structure having a plurality of cells, each cell having a front surface and a back surface;

a first pleat formed in the front surface of each cell;

a second pleat formed in the back surface of each cell;

wherein the first and second pleats split each cell into opposing upper and lower portions thereof;

wherein the collapsible structure expands in width when collapsed along the first and second pleats of each cell of the plurality of cells;

a plurality of fixed perforations of removed collapsible structure formed in each of the first and the second pleat of each cell thereby creating a plurality of discrete pathways entirely through each cell of the collapsible structure;

wherein each perforation comprises a shape having a first half that spans into the upper portion of a cell, and a second half that spans into the lower portion of the cell; and at least one mounting plate mounted to one of the plurality of cells, the at least one mounting plate being configured to secure the collapsible structure to a support structure.

2. The partition as recited in claim 1, wherein the perforations formed in the first pleat are aligned with the perforations formed in the second pleat.

3. The partition as recited in claim 1, wherein: each of the cells is joined to an adjacent cell at a horizontal seam.

4. The partition as recited in claim 3, wherein: the plurality of cells comprise a cell-in-cell configuration that comprises a first elongate cell that has been inserted within and bonded to a second elongate cell.

5. The partition as recited in claim 3, wherein: the plurality of cells comprise a triple-cell configuration that comprises a first elongate cell that has been bonded at both a vertical position and a horizontal position to at least another elongate cell.

6. The partition as recited in claim 5, wherein:

each of the plurality of perforations passes through the first and second elongate cells of each cell-in-cell configuration; and the collapsible partition intermittently blocks light from one side of the partition to an opposing side.

7. The partition as recited in claim 1, wherein the plurality of perforations comprise a plurality of different shapes.

8. The partition as recited in claim 7, wherein each of the different shapes alternates along the pleats corresponding to each cell.

9. The partition as recited in claim 7, wherein the plurality of different shapes of the perforations are distributed randomly along the pleats corresponding to each cell.

10. The partition as recited in claim 1, wherein the collapsible partition further comprises one or more collapse and release apparatus for differentially collapsing or expanding the partition in the one or more spaces.

11. The partition as recited in claim 1, wherein the collapsible partition is at least about 8 feet tall, and spans a ceiling to floor space when expanded.

* * * * *